US006502910B2

(12) United States Patent
Kuo-Chan

(10) Patent No.: US 6,502,910 B2
(45) Date of Patent: Jan. 7, 2003

(54) STOPPER DEVICE OF DRAWER SLIDE RAIL

(76) Inventor: Weng Kuo-Chan, No. 196-6, Hsin Chuang Li, Tuku Chen, Yun Lin Hsien (TW)

( * ) Notice: Subject to any disclaimer, the term of this patent is extended or adjusted under 35 U.S.C. 154(b) by 0 days.

(21) Appl. No.: 09/878,229

(22) Filed: Jun. 12, 2001

(65) Prior Publication Data

US 2002/0043915 A1 Apr. 18, 2002

(30) Foreign Application Priority Data

Jun. 12, 2000 (TW) ..... 89209971 U

(51) Int. Cl.[7] ..... A47B 88/00
(52) U.S. Cl. ..... 312/333; 312/334.46; 384/21
(58) Field of Search ..... 312/334.44, 334.45, 312/334.46, 334.47, 333; 384/21

(56) References Cited

U.S. PATENT DOCUMENTS

| | | | | | |
|---|---|---|---|---|---|
| 3,142,517 | A | * | 7/1964 | Ward | 384/21 |
| 3,904,254 | A | * | 9/1975 | Hagen et al. | 312/334.47 |
| 4,473,262 | A | * | 9/1984 | Staye | 312/333 |
| 4,560,212 | A | * | 12/1985 | Papp et al. | 312/334.47 |
| 5,255,983 | A | * | 10/1993 | Parvin | 384/21 |
| 5,417,490 | A | * | 5/1995 | Hobbs et al. | 312/334.47 |
| 5,542,759 | A | * | 8/1996 | Krivec | 312/334.44 |
| 5,775,787 | A | * | 7/1998 | Gasser | 312/334.46 X |
| 6,220,683 | B1 | * | 4/2001 | Chu | 312/334.44 |
| 6,350,001 | B1 | * | 2/2002 | Chu | 312/334.44 |
| 6,367,899 | B1 | * | 4/2002 | Hwang et al. | 312/334.47 |

FOREIGN PATENT DOCUMENTS

| | | | | |
|---|---|---|---|---|
| DE | 3326400 | * | 1/1985 | 312/334.47 |
| JP | 03090820 | * | 4/1991 | 384/21 |

* cited by examiner

*Primary Examiner*—Jose V. Chen
*Assistant Examiner*—Hanh V. Tran
(74) *Attorney, Agent, or Firm*—Troxell Law Office PLLC

(57) ABSTRACT

A stopper device of a drawer slide rail, including an outer slide rail, a middle slide rail, an inner slide rail, an outer stop section and an inner stop section. The outer slide rail is disposed on a cabinet body. The outer stop section is disposed at one end of the middle slide rail. The inner stop section is disposed in the inner slide rail. The inner slide rail is disposed on a drawer. The slide rails are slidably assembled with each other. The inner stop section is stopped by or disengaged from the outer stop section so as to easily connect the drawer with the cabinet body or separate the drawer therefrom.

6 Claims, 4 Drawing Sheets

STOPPER DEVICE OF DRAWER SLIDE RAIL

BACKGROUND OF THE INVENTION

The present invention is related to a sliding device between two articles, and more particularly to a slide rail device mounted between a drawer and a file cabinet.

Conventionally, two or three corresponding rails are disposed between a drawer and a cabinet body. The rails are slidably assembled with each other, whereby the drawer can be pushed and drawn within the cabinet body. In addition, stop sections such as projecting blocks or plates are disposed between two corresponding rails to avoid separation and dropping of the drawer from the cabinet body when drawn. The frictional force between the rails is considerably great so that it is strength-costing to push/pull the drawer and great noise will be produced. In addition, the drawer can be hardly snugly assembled with the cabinet body so that when drawn or pushed, the drawer tends to swing up and down and left and right. Moreover, the stop sections serve to prevent the drawer from dropping from the cabinet body. However, when it is necessary to detach the drawer from the cabinet body or reassemble the drawer with the cabinet body, a user has to move the drawer up or down to a fixed position for detaching or reassembling the drawer. This is uneasy and inconvenient for the user.

Furthermore, ball bearings are disposed between two corresponding rails to facilitate sliding. Referring to FIGS. 1 and 2, a substantially reverse V-shaped stop plate is disposed on a conventional drawer slide rail. The top end X of the stop plate is formed with an opening and pivotally connected with bottom face of the drawer slide rail by a rivet. The end edge of one side abuts against one side of the drawer slide rail, while the other side is formed with an outward projecting stop face Y corresponding to a stop block of one end of the middle slide rail along with the drawer slide rail is slidable. The stop face Y is stopped by the stop block, whereby when outward drawing the drawer, the drawer is prevented from separating and dropping from the cabinet body. When it is desired to detach the drawer, in short side direction, a finger exerts a force onto one side of the stop plate with the stop face Y so as to pivotally rotate the stop plate about the rivet at the top end X. Therefore, the stop face Y is disengaged from the stop block, permitting the drawer to be further drawn out and separated from the cabinet body.

When outward drawing the drawer, when the stop face Y hits and abuts against the stop block, the top end X of the stop plate also suffers a hitting force. The stress is concentrated so that the top end X tends to break and damage and shorten the using life. Moreover, the top end X is pivotally connected with the bottom face of the drawer slide rail by the rivet. In case of incaution, when riveted, the rivet often is tightly connected with the top end X so that the stop plate can be hardly pivotally rotated about the rivet. Therefore, the ratio of defective products is higher.

SUMMARY OF THE INVENTION

It is therefore a primary object of the present invention to provide a stopper device of drawer slide rail by which when drawing out the drawer, the using life of the stop plate is prolonged.

It is a further object of the present invention to provide the above stopper device of drawer slide rail which has a buffer safety means for truly stopping the drawer.

It is still a further object of the present invention to provide the above stopper device of drawer slide rail in which the stop plate can be easily assembled and the manufacturing cost is lowered.

According to the above objects, the stopper device of drawer slide rail of the present inventin includes an outer slide rail, a middle slide rail, an inner slide rail, an outer stop section and an inner stop section. The outer slide rail is disposed on a cabinet body. The outer stop section is disposed at one end of the middle slide rail. The inner stop section is disposed in the inner slide rail. The inner slide rail is disposed on a drawer.

The present invention can be best understood through the following description and accompanying drawings wherein:

DETAILED DESCRIPTION OF THE PREFERRED EMBODIMENTS

Figure 1:
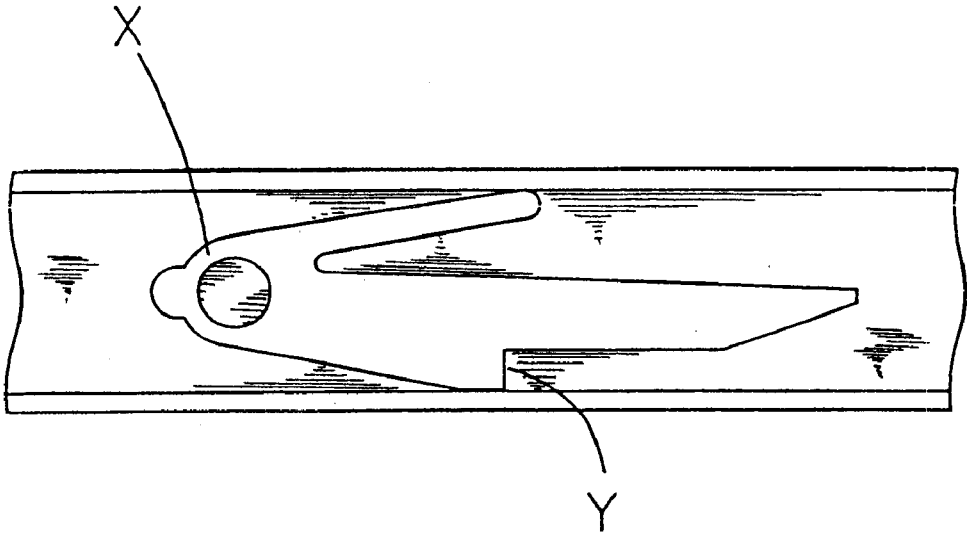
FIG.1 Prior Art
FIG. 1 shows the stop plate of a conventional slide rail.
Figure 2:
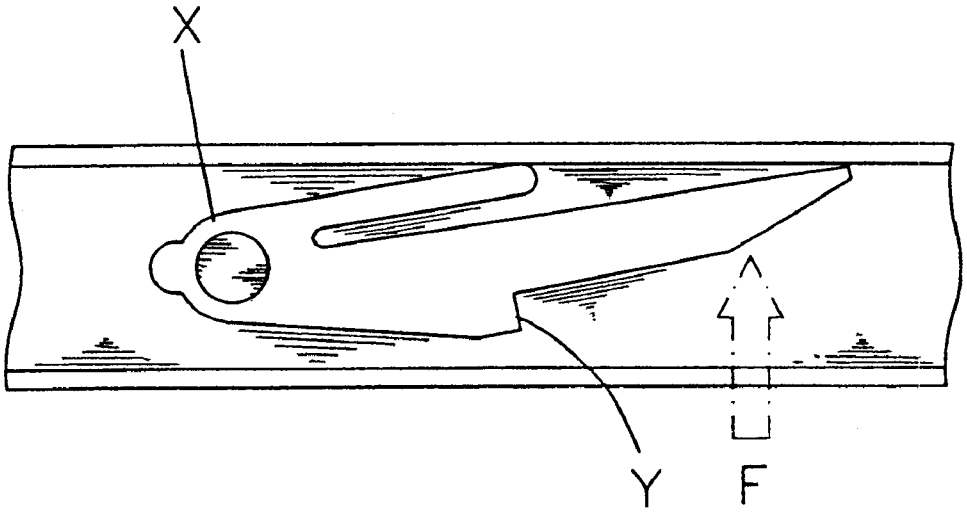
FIG.2 Prior Art
FIG. 2 shows that the stop plate of the conventional slide rail is driven by a finger.
Figure 3:
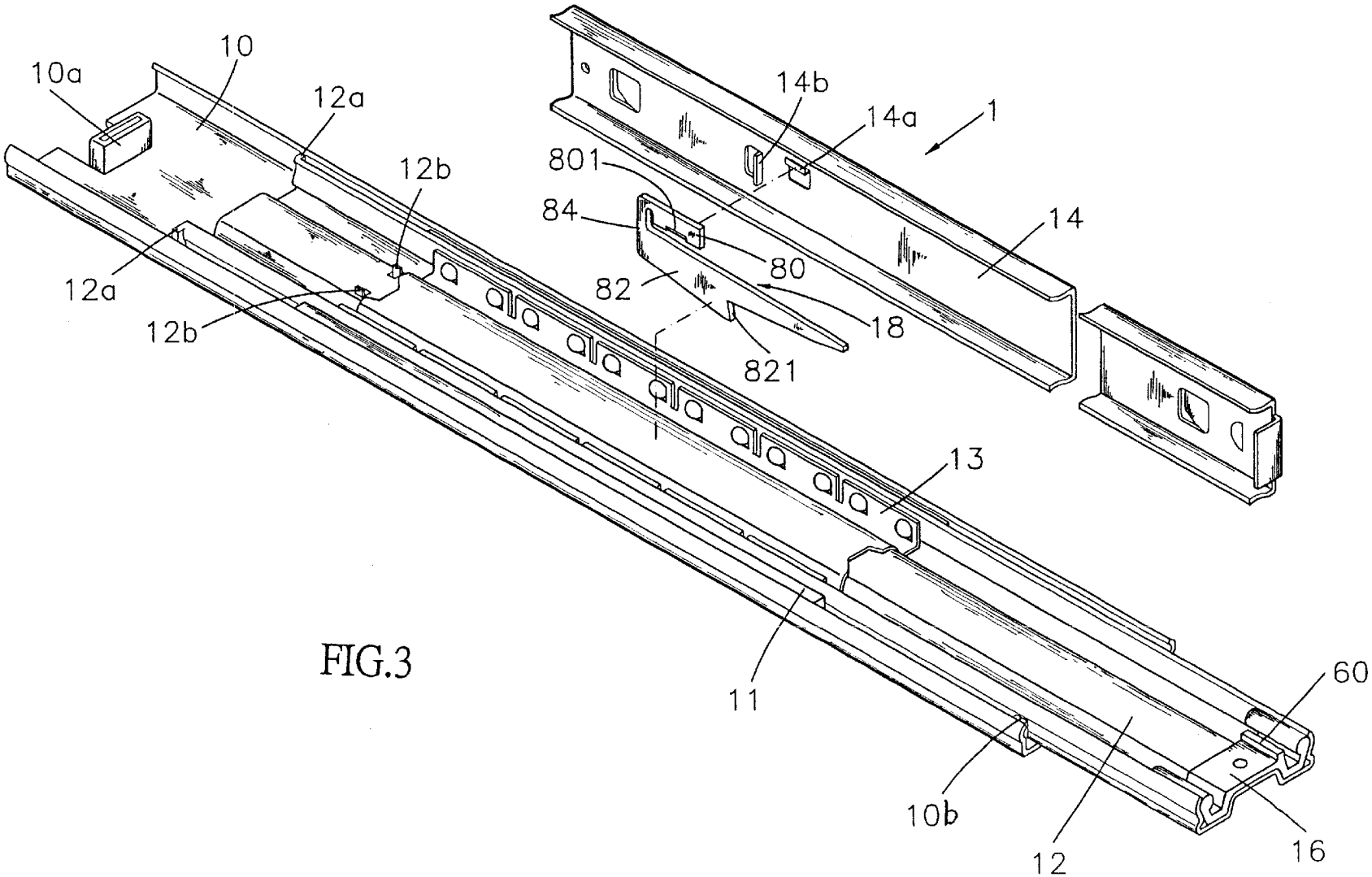
FIG. 3 is a perspective exploded view of a first embodiment of the present invention.
Figure 4A:
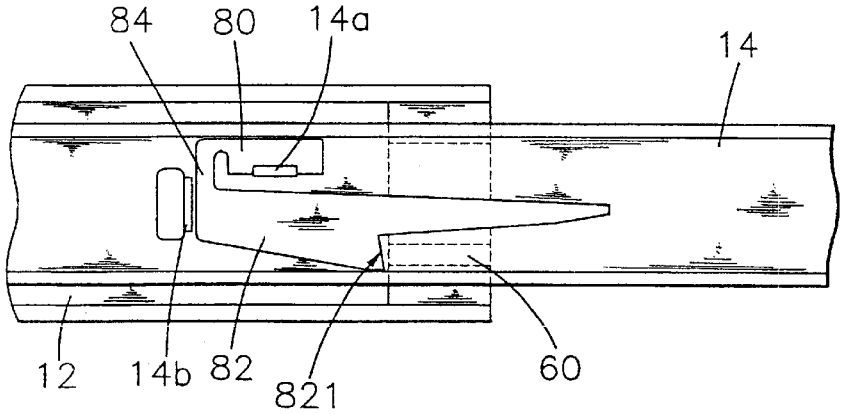
FIG. 4A–C shows the operation of the inner stop section of the first embodiment of the present invention.
Figure 4B:
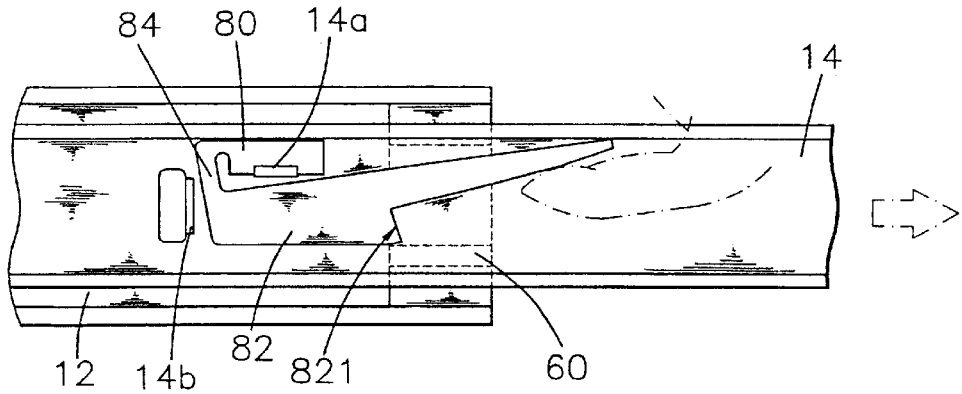
Figure 4C:
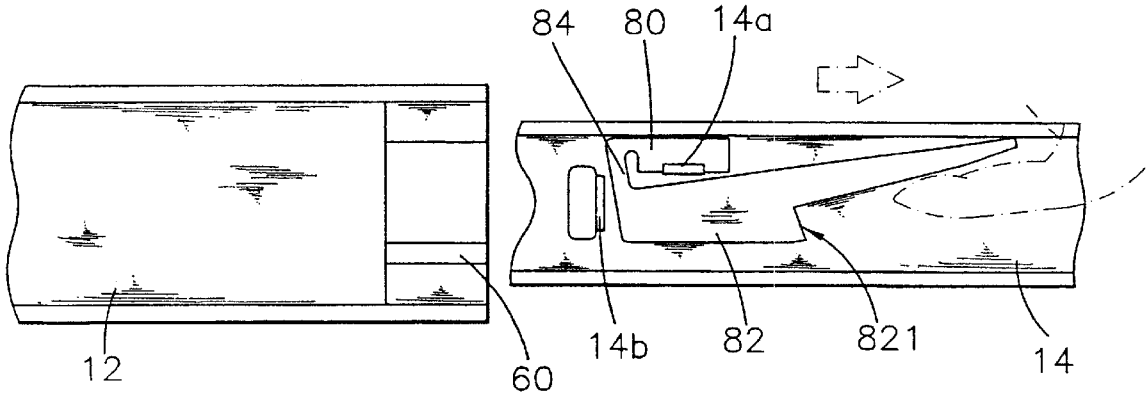

Please refer to FIGS. 3 and 4. The stopper device 1 of drawer slide rail of the present invention is composed of an outer slide rail 10, a middle slide rail 12, an inner slide rail 14, an outer stop section 16 and an inner stop section 18. A first ball bearing 11 is disposed between the outer and middle slide rails 10, 12 and a second ball bearing 13 is disposed between the middle and inner slide rails 12, 14.

The middle slide rail 12 is disposed inside the outer slide rail 10 and the inner slide rail 14 is disposed inside the middle slide rail 12.

The outer slide rail 10 is a channel body having a predetermined length and U-shaped cross-section. Two side walls of the outer slide rail 10 are ball rails with C-shaped cross-section. Two ends are respectively provided with an outer slide rail stop section 10*a* and two first ball bearing stop sections 10*b* respectively for stopping the middle slide rail 12 and the first ball bearing 11.

The middle slide rail 12 is a channel body having a predetermined length. Two sides of the bottom of the middle slide rail 12 have U-shaped cross-section and the middle portion of the bottom has reverse U-shaped cross-section. Two side walls of the middle slide rail 12 are ball rails with C-shaped cross-section. Two sides of one end are provided with an abutting section 12*a* for abutting against the first ball bearing. The middle portion of inner side of the bottom is provided with a second ball bearing stop section 12*b* for stopping the second ball bearing 13.

The inner slide rail 14 is a channel body having a predetermined length and U-shaped cross-section. Two side walls of the inner slide rail 14 are ball rails with C-shaped cross-section. The middle portion of inner side of the bottom is provided with an insertion plate 14*a* and a buffer plate 14*b*.

The outer stop section 16 is disposed at an end of the middle slide rail 12 opposite to the first ball bearing abutting section 12*a*. The shape of the cross-section of the outer stop section 16 substantially corresponds to that of the middle slide rail 12. The outer stop section 16 has a cross-sectional stop face 60 corresponding to the reverse U-shaped cross-section of the middle of the bottom of the middle slide rail 12.

The inner stop section 18 is composed of a fixing section 80, a swinging section 82 and a bending section 84.

The fixing section 80 is substantially rectangular and formed with a recessed insertion section 801 corresponding to the profile of the insertion plate 14*a*. The minimum width in short side direction between the outer edge of the fixing section 80 and the outer edge of the insertion section 801 corresponds to the minimum width between one side of the inner slide rail 14 and the outer edge of the insertion plate 14*a*, whereby the fixing section 80 is slidably inlaid in the inner slide rail 14.

The swinging section 82 has a substantially elongated rectangular shape. The middle portion thereof is formed with an inner stop face 821 outward projecting by a predetermined height corresponding to the stop face 60.

The bending section 84 is substantially C-shaped for integrally connecting the corresponding ends of the fixing section 80 and the swinging section 82, whereby the fixing section 80 and the swinging section 82 are positioned on the same side of the bending section 84 and substantially parallelly spaced by a predetermined distance. One end of a portion of the bending section 84 connecting with the fixing section 80 is formed with a neck section, whereby an L-shaped gap is defined between the fixing section 80 and the swinging section 82.

The buffer plate 14*b* is a lug substantially corresponding to the length and height of the bending section 84. The buffer plate 14*b* is positioned opposite to the swinging section 82 and spaced from the bending section 84 by a predetermined distance.

The present invention has advantages as follows:

1. In the case that an excessively great force is applied to the drawer for drawing open the drawer, when the inner stop face 821 collides the stop face 60, the swinging section 82 and the bending section 84 are deformed and displaced in the long side direction. At this time, the buffer plate 14*b* provides an abutting and protection function to avoid breakage of the inner stop section 18 and prolong using life.
2. The fixing section 80 is slidably inserted in the inner slide rail 14. This assembling measure is quicker than the conventional rivet measure. Also, by means of the L-shaped gap between the fixing section 80 and the swinging section 82, the rotary shaft necessary in the conventional structure is omitted.
3. When it is desired to draw the drawer out of the cabinet body, by means of the L-shaped gap between the fixing section 80 and the swinging section 82, a user can more easily and smoothly drive the swinging section 82.

Figure 5A:
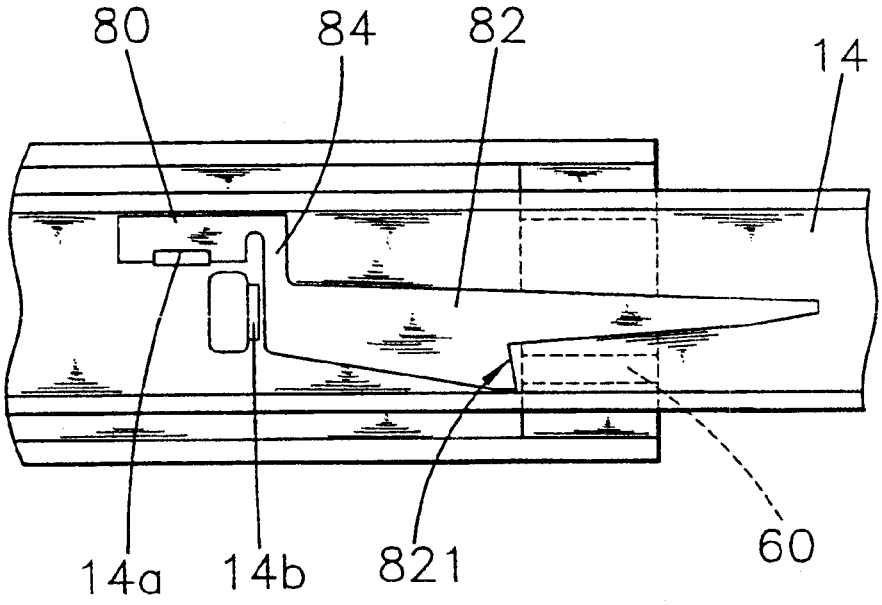
FIG. 5A–B shows the operation of the inner stop section of a second embodiment of the present invention.
Figure 5B:
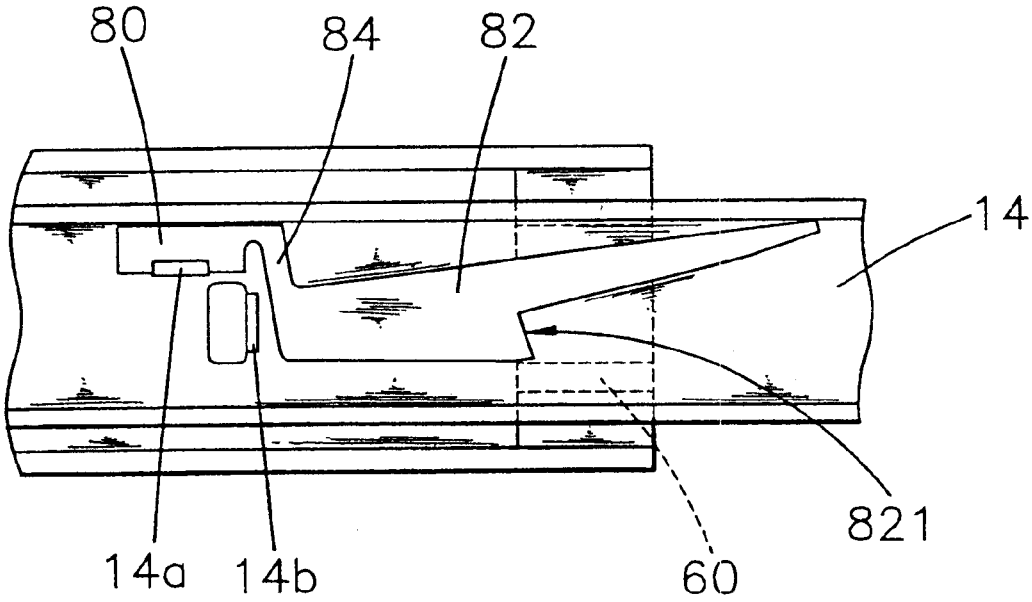

FIG. 5 shows another embodiment of the present invention, in which the fixing section 80 of the stopper device 1 is not positioned on the same side of the swinging section 82.

The insertion section 801 can be an opening. Also, the outer edge of the fixing section 80 abutting against one side of the inner slide rail 14 is formed with a slope corresponding to the angle contained by the bottom face of the inner slide rail 14 and the inner edge of the lateral face thereof. When assembling the inner stop section 18 with the inner slide rail 14, the fixing section 80 is more firmly slidably inlaid in the inner slide rail 14 without easy detachment.

The above embodiments are only used to illustrate the present invention, not intended to limit the scope thereof. Many modifications of the above embodiments can be made without departing from the spirit of the present invention.

What is claimed is:

1. A stopper device of a drawer slide rail, comprising:

an outer slide rail having a predetermined length and first ball rails;

a middle slide rail having a predetermined length and second ball rails;

a inner slide rail having a predetermined length and third ball rails;

a first ball bearing disposed between the first and second ball rails of the outer and middle slide rails;

a second ball bearing disposed between the second and third ball rails of the middle and inner slide rails;

an outer slide rail stop section disposed at a first end of the outer slide rail for stopping the middle slide rail;

a first ball bearing stop section disposed at a second end of the outer slide rail for stopping the first ball bearing;

two abutting sections disposed on two sides of one end of the middle slide rail for abutting against the first ball bearing;

a second ball bearing stop section disposed on a middle portion of a bottom inner side of the middle slide rail for stopping the second ball bearing;

a stop section disposed at an outer end of the middle slide rail and having a cross-sectional stop face;

an inner stop section including:

a fixing section having a predetermined shape and being slidably disposed at a predetermined portion of a middle of a bottom face of the inner slide rail;

a swinging section having a predetermined shape, a middle portion thereof being formed with an inner stop outwardly projecting by a predetermined height corresponding to and abutting against the stop face of the outer stop section;

a bending section connecting corresponding ends of the fixing section and the swinging section, whereby the fixing section and the swinging section are substantially parallelly spaced by a predetermined distance, one end of a portion of the bending section connecting with the fixing section being formed with a neck section, whereby an L-shaped gap is defined between the fixing section and the swinging section; and a buffer plate which is a lug having a predetermined height, the buffer plate being disposed on a bottom face of the inner slide rail corresponding to and spaced from the bending section by a predetermined distance.

2. The stopper device of a drawer slide rail as claimed in claim 1, wherein an insertion plate is disposed at a predetermined portion of the bottom face of the inner slide rail and a predetermined portion of the fixing section is formed with an insertion section corresponding to the profile of the insertion plate.

3. The stopper device of a drawer slide rail as claimed in claim 2, wherein in a short side direction of the inner slide rail, a minimum width of the fixing section between the outer edge of the fixing section and the outer edge of the insertion section corresponds to the minimum width between one side of the inner slide rail and the outer edge of the insertion plate.

4. The stopper device of a drawer slide rail as claimed in claim 2, wherein the insertion section is a recess.

5. The stopper device of a drawer slide rail as claimed in claim 2, wherein the insertion section is an opening.

6. The stopper device of a drawer slide rail as claimed in claim 3, wherein the outer edge of the fixing section is formed with a slope corresponding to an angle contained by the bottom face of the inner slide rail and the inner edge of the lateral face thereof.

* * * * *